US007914134B2

(12) United States Patent
Sugahara

(10) Patent No.: US 7,914,134 B2
(45) Date of Patent: Mar. 29, 2011

(54) INK CARTRIDGES AND INKJET PRINTERS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 820 days.

(21) Appl. No.: 11/690,313

(22) Filed: Mar. 23, 2007

(65) Prior Publication Data

US 2007/0229618 A1 Oct. 4, 2007

(30) Foreign Application Priority Data

Mar. 30, 2006 (JP) ..... 2006-095662

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS

| | | | | |
|---|---|---|---|---|
| 5,541,631 | A | 7/1996 | Hashimoto | |
| 5,604,523 | A | 2/1997 | Tsukuda et al. | |
| 5,883,653 | A * | 3/1999 | Sasaki | 347/86 |
| 6,270,207 | B1 | 8/2001 | Sasaki | |
| 6,540,342 | B2 * | 4/2003 | Koshikawa et al. | 347/86 |
| 6,554,411 | B1 | 4/2003 | Hatasa et al. | |
| 2005/0052511 | A1 | 3/2005 | Seino et al. | |
| 2005/0134661 | A1 | 6/2005 | Miyazawa | |
| 2005/0270344 | A1 * | 12/2005 | Tsujimoto et al. | 347/86 |
| 2006/0119677 | A1 | 6/2006 | Shinada et al. | |
| 2006/0164482 | A1 | 7/2006 | Katayama et al. | |
| 2007/0070151 | A1 | 3/2007 | Hattori et al. | |

FOREIGN PATENT DOCUMENTS

| | | |
|---|---|---|
| CN | 2513769 | 10/2002 |
| JP | H02-243351 A | 9/1990 |
| JP | 2005238815 A | 9/2005 |

OTHER PUBLICATIONS

Chinese Patent Office, Chinese Office Action issued in corresponding Chinese Application No. 200710088502.4 dated Dec. 5, 2008.

* cited by examiner

*Primary Examiner* — Stephen D Meier
*Assistant Examiner* — Alexander C Witkowski
(74) *Attorney, Agent, or Firm* — Baker Botts L.L.P.

(57) ABSTRACT

An ink cartridge includes an ink chamber configured to store an ink, and a wall which includes a first end and a second end opposite the first end. The ink cartridge also includes an ink supply portion configured to supply the ink from an interior of the ink chamber to an exterior of the ink chamber, and the ink supply portion is positioned at the wall adjacent to the second end of the wall. Moreover, the ink cartridge includes a protrusion extending from the wall, and the protrusion is positioned between the ink supply portion and the second end of the wall. In embodiment, the protrusion has a plurality of grooves formed therein. In another embodiment, the protrusion has a plurality of openings formed therethrough or therein.

22 Claims, 9 Drawing Sheets

INK CARTRIDGES AND INKJET PRINTERS

The present application claims priority from Japanese Patent Application No. JP-2006-095662, which was filed on Mar. 30, 2006, the disclosure of which is incorporated herein by reference in its entirety.

BACKGROUND OF THE INVENTION

1. Field of the Invention

The present invention relates generally to ink cartridges and inkjet printers. In particular, the present invention is directed towards ink cartridges and inkjet printers, in which when ink drips from an ink supply portion of the ink cartridge, a protrusion receives the ink and retains the ink because of a capillary force created by grooves or holes formed in the protrusion.

2. Description of Related Art

A known inkjet recording system, such as the inkjet recording system described in JP2005-238815, includes an inkjet recording apparatus and a plurality of ink cartridges mounted side by side to a mounting portion of the inkjet recording apparatus. An ink supply opening is formed at one surface of the ink cartridge. An ink supply needle provided in the inkjet recording apparatus, is inserted through the ink supply opening when the ink cartridge is mounted to the inkjet recording apparatus, and ink within the ink cartridge is supplied to the inkjet recording apparatus. The ink cartridge includes a case, and a bag positioned within the case. The bag has a port for supplying ink within the bag to the outside of the ink cartridge, and the port is aligned with the ink supply opening. Within the port, a lid, a valve, and a spring are provided. The spring urges the valve, such that the valve contacts the lid. When the valve contacts the lid, the inside of the bag and the outside of the ink cartridge are not in fluid communication with each other. Nevertheless, when the ink supply needle pushes the valve against the urging force of the spring and the valve separates from the lid, the inside of the bag is in fluid communication with the outside of the ink cartridge.

Ink adheres to the ink supply needle after the ink supply needle is inserted into the ink cartridge through the ink supply opening. The ink adhering to the ink supply needle adheres to an area adjacent to the ink supply opening when the ink cartridge is removed from the mounting portion. The ink may drip from the ink supply opening on to the mounting portion. If the ink drips from the ink supply opening on to the mounting portion, the mounting portion becomes dirtied. In addition, ink may drip from the ink supply needle on to the mounting portion. After the mounting portion becomes dirtied, when a new ink cartridge is mounted to the mounting portion, the new ink cartridge also becomes dirtied. When a user of the inkjet recording system removes the new ink cartridge from the mounting portion, a hand of the user also may become dirtied. This is problematic, especially when the communication between the inside of the ink cartridge and the outside of the ink cartridge is prohibited by the valve urged by the spring. When the ink supply needle is removed from the ink supply opening, the spring pushes the valve back toward the ink supply opening. Therefore, ink is pushed by the valve toward the ink supply opening. A large amount of ink may be pushed out of the ink supply opening.

Another known ink cartridge includes an ink supply portion extending from one surface of the ink cartridge. An ink supply opening is formed at the end of the ink supply portion.

Ink also may drip from the ink supply opening of this type of ink cartridge on to a mounting portion of an inkjet recording apparatus.

SUMMARY OF THE INVENTION

Therefore, a need has arisen for ink cartridges and inkjet printers which overcome these and other shortcomings of the related art. A technical advantage of the present invention is that when ink drips from an ink supply portion of the ink cartridge, a protrusion receives the ink and retains the ink because of a capillary force created by grooves or holes formed in the protrusion. Consequently, in operation, no ink or substantially no ink is transferred from the ink cartridge to a mounting portion of the inkjet printer.

According to an embodiment of the present invention, an ink cartridge comprises an ink chamber configured to store an ink, and a wall comprising a first end and a second end opposite the first end. The ink cartridge also comprises an ink supply portion configured to supply the ink from an interior of the ink chamber to an exterior of the ink chamber, and the ink supply portion is positioned at the wall adjacent to the second end of the wall. Moreover, the ink cartridge comprises a protrusion extending from the wall, and the protrusion is positioned between the ink supply portion and the second end of the wall. In an embodiment of the present invention, the protrusion comprises means for generating a capillary force which acts upon the ink when the ink is positioned on the protrusion. For example, in an embodiment of the present invention, the protrusion has a plurality of grooves formed therein. In another embodiment of the present invention, the protrusion has a plurality of openings formed therethrough or therein.

According to another embodiment of the present invention, an inkjet printer comprises a mounting portion and an ink cartridge mounted to the mounting portion. The ink cartridge comprises an ink chamber configured to store an ink, and a wall comprising a first end and a second end opposite the first end. The ink cartridge also comprises an ink supply portion configured to supply the ink from an interior of the ink chamber to an exterior of the ink chamber, and the ink supply portion is positioned at the wall adjacent to the second end of the wall. Moreover, the ink cartridge comprises a protrusion extending from the wall, and the protrusion is positioned between the ink supply portion and the second end of the wall. In an embodiment of the present invention, the protrusion comprises means for generating a capillary force which acts upon the ink when the ink is positioned on the protrusion. For example, in an embodiment of the present invention, the protrusion has a plurality of grooves formed therein. In another embodiment of the present invention, the protrusion has a plurality of openings formed therethrough or therein. Moreover, the mounting portion has a recess formed therein, the recess is configured to receive the protrusion, and the mounting portion comprises a detector configured to detect a presence of the protrusion.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

FIG. 3(*b*) is a partial, cross-sectional view of the ink cartridge and the inkjet printer of FIG. 1, after the mounting of the ink cartridge to the inkjet printer is completed.

FIG. 4(*b*) is a schematic diagram of the ink cartridge of FIG. 1, when ink is dripping.

FIG. 4(*c*) is a schematic diagram of the ink cartridge of FIG. 1, when ink has dripped on to a protrusion.

DETAILED DESCRIPTION OF EMBODIMENTS OF THE INVENTION

Embodiments of the present invention, and their features and advantages, may be understood by referring to FIGS. 1-9, like numerals being used for like corresponding parts in the various drawings.

Figure 1:
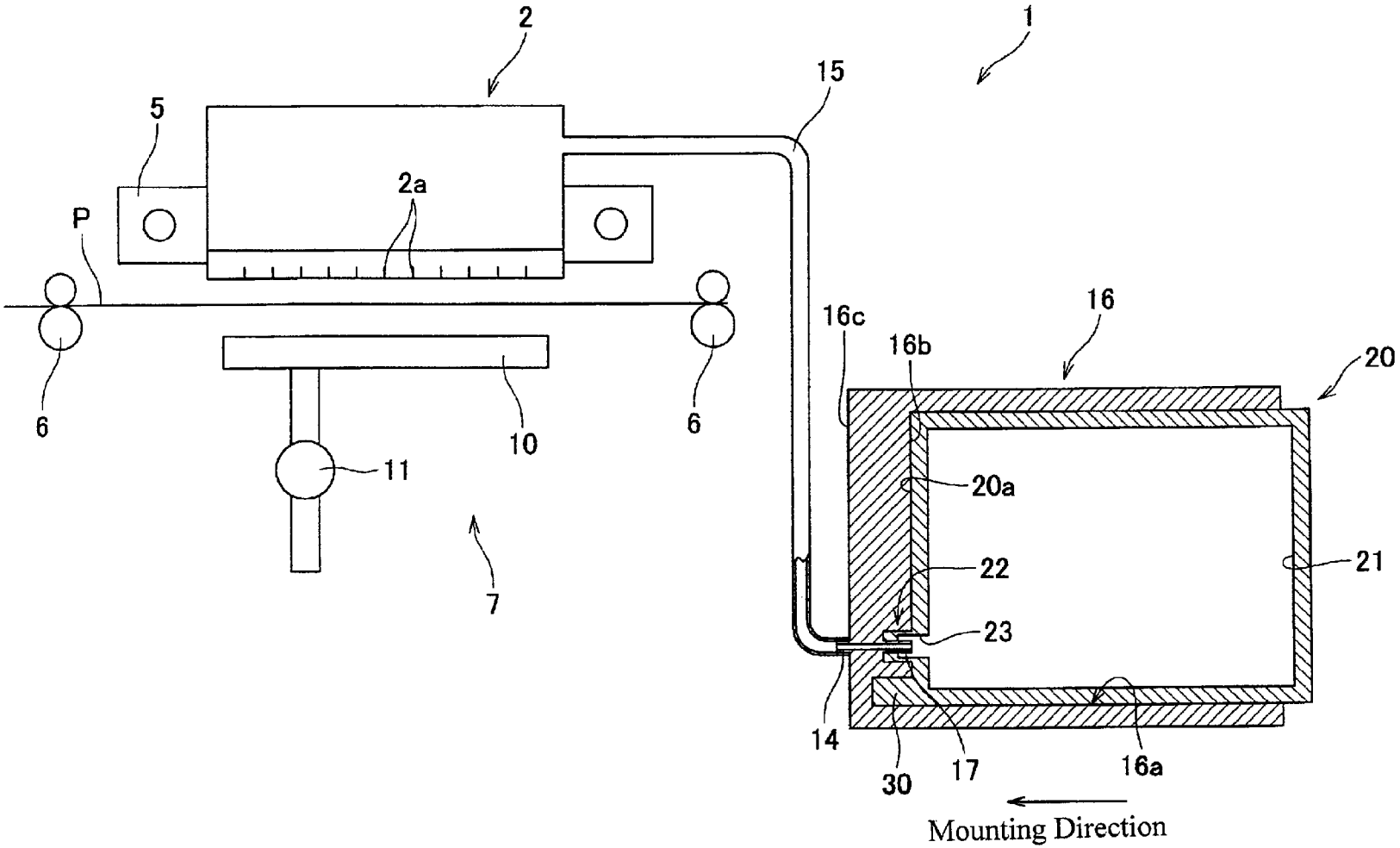
FIG. 1 is a schematic diagram of an inkjet printer and an ink cartridge, according to an embodiment of the present invention.

FIG. 1 is a schematic diagram of an inkjet printer 1 and an ink cartridge 20, according to an embodiment of the present invention. Inkjet printer 1 comprises an inkjet head 2, a mounting portion 16, a flexible tube 15, a carriage 5, a feeding mechanism 6, and a purge device 7. Inkjet head 2 comprises a plurality of nozzles 2*a* configured to eject ink toward a recording paper P. Mounting portion 16 is configured to mount ink cartridge 20. When ink cartridge 20 is mounted to mounting portion 16, ink cartridge 20 and inkjet head 2 communicate with each other via tube 15. Carriage 5 is configured to reciprocate with inkjet head 2, and feeding mechanism 6 is configured to feed recording paper P. Purge device 7 is configured to draw air or thickened ink from the inside of inkjet head 2.

During a printing operation, inkjet head 2 reciprocates with carriage 5 in a direction which is perpendicular to a plane of FIG. 1, and recording paper P is fed by feeding mechanism 6 in a horizontal direction in FIG. 1. Inkjet head 2 faces recording paper P. The reciprocation of inkjet head 2 and the feeding of recording paper P are synchronized by a control means. Each time that inkjet head 2 crosses recording paper P, inkjet head 2 ejects ink from nozzles 2*a*. Ink is supplied from ink cartridge 20 mounted to mounting portion 16 to inkjet head 2 via tube 15. Nozzles 2*a* are positioned above mounting portion 16 and ink cartridge 20 to prevent ink from leaking from nozzles 2*a* when the printing operation is not performed.

Purge device 7 comprises a cap 10 and a pump 11, and cap 10 is configured to selectively move toward and away from an ink-eject surface of inkjet head 2. Nozzles 2*a* are positioned at the ink-eject surface, and cap 10 is configured to cover the ink-eject surface. Pump 11 is configured to draw ink from nozzles 2*a*. When inkjet head 2 is positioned outside of a printable area, cap 10 may cover the ink-eject surface, and pump 11 may draw air or thickened ink from nozzles 2*a*. The printable area is an area where inkjet head 2 may eject ink toward recording paper P. Evaporation of water from the ink may result in the thickening of the ink in nozzles 2. This purge operation may recover ink-eject performance of inkjet head 2.

Mounting portion 16 opens to the right in FIG. 1. Ink cartridge 20 may be inserted and mounted horizontally into an inside 16*a* of mounting portion 16 from the opening. Ink cartridge 20 may be removed from mounting portion 16 by pulling on a right edge of ink cartridge 20 to the right in FIG. 1.

Figure 2:
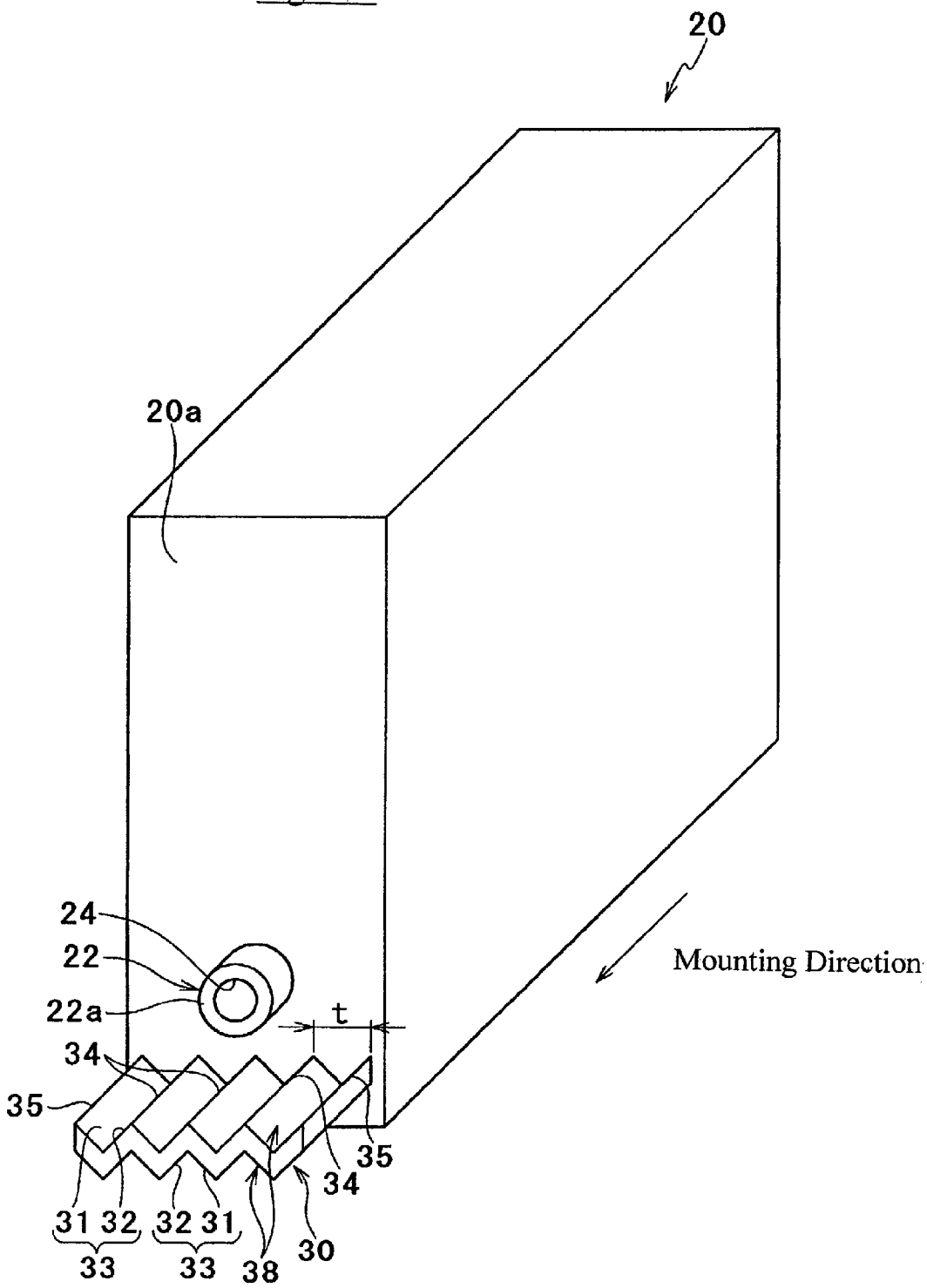
FIG. 2 is a perspective view of the ink cartridge of FIG. 1.
Figure 3A:
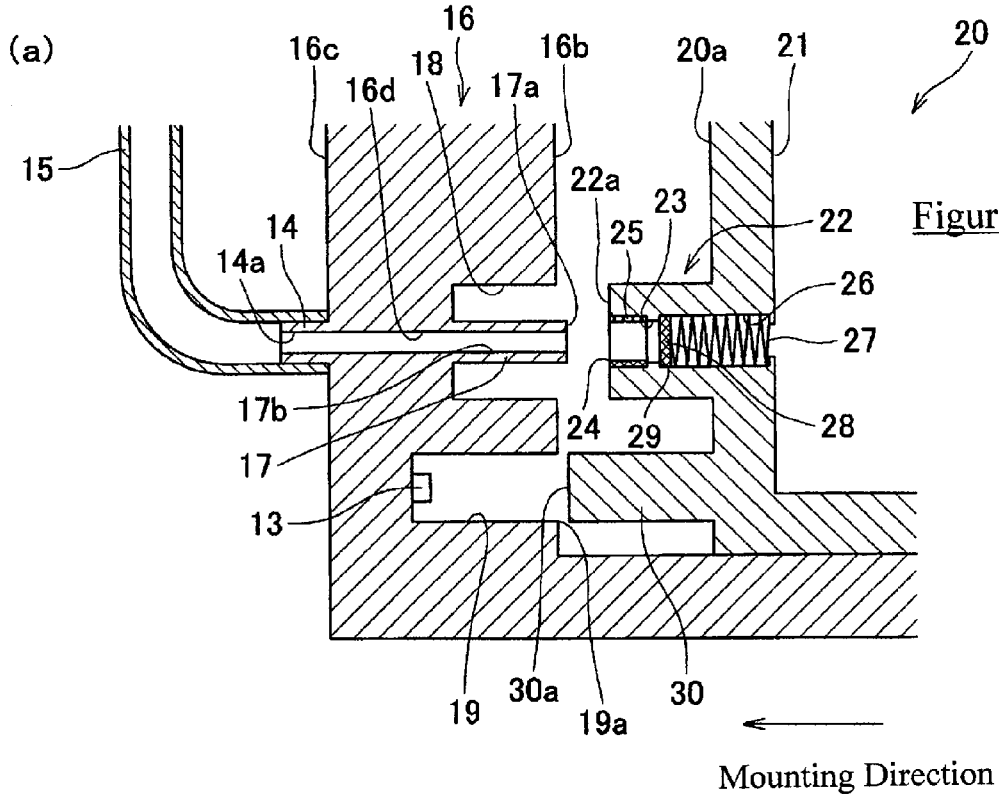
FIG. 3(*a*) is a partial, cross-sectional view of the ink cartridge and the inkjet printer of FIG. 1, just before a mounting of the ink cartridge to the inkjet printer is completed.
Figure 3B:
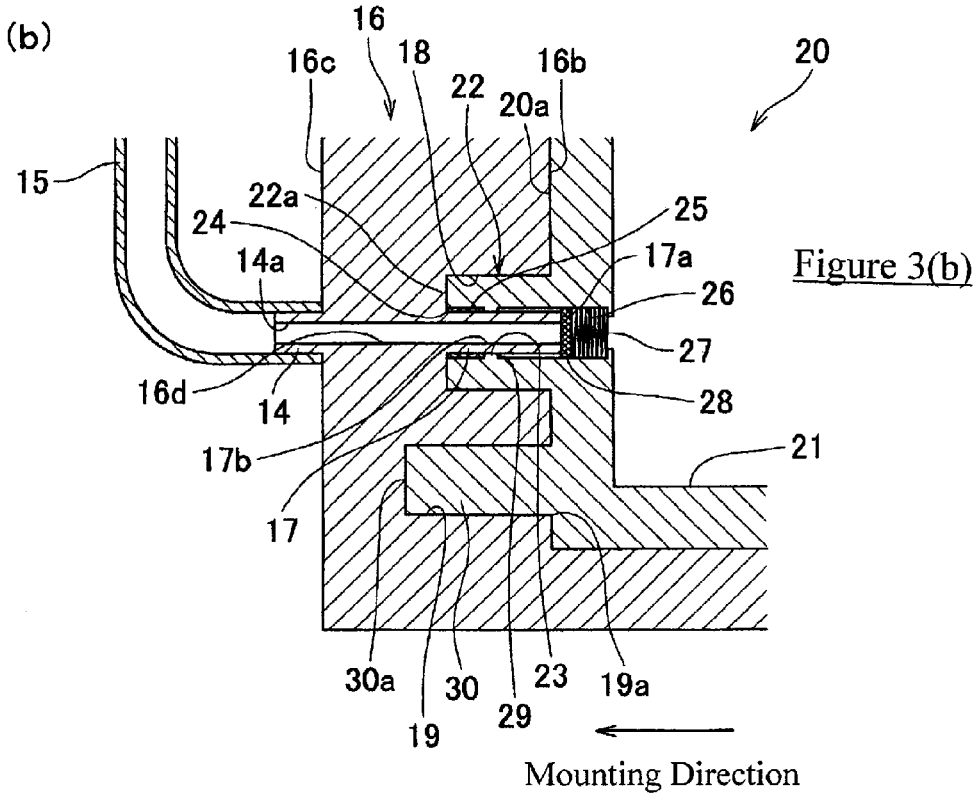

FIG. 2 is a perspective view of ink cartridge 20. FIG. 3(*a*) is a partial, cross-sectional view of ink cartridge 20 and inkjet printer 1, just before the mounting of ink cartridge 20 in mounting portion 16 is completed. FIG. 3(*b*) is a partial cross-sectional view of ink cartridge 20 and inkjet printer 1, after the mounting of ink cartridge 20 in mounting portion 16 is completed.

Ink cartridge 20 may have a rectangular parallelepiped shape. An ink chamber 21 is provided within ink cartridge 20. Ink cartridge 20 comprises a side wall 20*a* and a cylindrical ink supply portion 22 extending from side wall 20*a*. Side wall 20*a* faces an end wall 16*b* of mounting portion 16, and ink supply portion 22 extends toward end wall 16*b* when ink cartridge 20 is mounted to mounting portion 16. The direction that ink supply portion 22 extends is parallel with a direction that ink cartridge 20 is mounted to mounting portion 16. Ink supply portion 22 has an ink supply path 23 formed therethrough. Ink supply path 23 communicates with ink chamber 21 and an outside of ink cartridge 20. Ink may be supplied from an interior of ink chamber 21 to an exterior of the ink chamber 21 via ink supply path 23. Ink supply path 23 extends in a direction which is parallel to the direction ink cartridge 20 is mounted to mounting portion 16. Ink supply portion 22 has an end surface 22*a*, which is most distant from side wall 20*a*. End surface 22*a* has an ink supply opening 24 formed therein. Ink supply path 23 opens to the outside of ink cartridge 20 at ink supply opening 24. Ink is supplied from ink chamber 21 to the outside of ink cartridge 20 via ink supply path 23 in a direction which is both parallel to the direction that ink cartridge 20 is mounted to mounting portion 16, and is perpendicular to end surface 22*a*. Accordingly, ink supply opening 24 is formed in a plane that is perpendicular to the direction that ink is supplied from ink chamber 21 to the outside of ink cartridge 20 via ink supply path 23.

A cylindrical-tube shaped seal 25 is provided in ink supply path 23. Ink supply path 23 has a center between ink chamber 21 and ink supply opening 24. Seal 25 is positioned between ink supply opening 24 and a center of ink supply path 23. Seal 25 comprises an elastic material, such as rubber. An ink supply tube 17 provided in mounting portion 16 moves into seal 25 when ink cartridge 20 is mounted to mounting portion 16. Seal 25 is elastically pressed against an outside surface of ink supply tube 17, which prevents ink from leaking between the outside surface of ink supply tube 17 and seal 25. Ink supply path 23 comprises a wider portion 26, and wider portion 26 has a radius which is greater than a radius of ink supply opening 24. Wider portion 26 extends from ink chamber 21 to about the center of ink supply path 23. A coil spring 27 and a valve 28 are provided within wider portion 26. Coil spring 27 is positioned between valve 28 and ink chamber 21, and urges valve 28 toward the outside of ink cartridge 20 in the direction which ink cartridge 20 is mounted to mounting portion 16. Wider portion 26 connects with the rest of ink supply path 23 at a connecting surface 29. Valve 28 has a radius, which is greater than a radius of the rest of ink supply path, but is less than the radius of wider portion 26. Valve 28 is urged against connecting surface 29, which prevents ink from leaking from ink chamber 21 to the outside of ink cartridge 20. When ink supply tube 17 pushes valve 28 against the force of coil spring 27 and valve 28 separates from connecting surface 29, ink flows into ink supply tube 17.

Ink cartridge 20 comprises a protrusion 30 which extends from side wall 20*a* in the direction which ink cartridge 20 is mounted to mounting portion 16. The direction which protrusion 30 extends is perpendicular to end surface 22*a*. Cross-sectional shapes of protrusion 30 taken along a plane which is perpendicular to the direction that ink cartridge 20 is mounted to mounting portion 16 may be the same at any position of protrusion 30. Side wall 20*a* has a first end and a second end opposite the first end. Ink supply portion 22 is positioned adjacent to the second end of side wall 20*a*, and protrusion 30 is positioned between ink supply portion 22 and the second end of side wall 20*a*. When ink cartridge 20 is mounted to mounting portion 16, protrusion 30 is positioned below ink supply portion 22. Protrusion 30 extends from side wall 20*a* further than ink supply portion 22 extends from side wall 20*a*. Protrusion 30 has an end surface 30*a*, which is most distant from side wall 20*a*, and surface 30*a* is positioned further from side wall 20*a* than end surface 22*a* is positioned from side wall 20*a*. Side wall 20*a* has a third end and fourth end opposite the third end. Side wall 20*a* has a height between the first end of the side wall 20*a* and the second end of the side wall 20*a*, and side wall 20 has a width between the third end of the side wall 20*a* and the fourth end of the side wall 20*a*. The direction of the height of side wall 20*a* is perpendicular to the direction of the width of side wall 20*a*. The height of ink cartridge 20 corresponds to the height of the side wall 20*a*, and the width of the ink cartridge 20 corresponds to the width of side wall 20*a*. Protrusion 30 may have substantially the same width as that of side wall 20*a*. When viewed from the height direction, ink supply portion 20 overlaps protrusion 30. When ink cartridge 20 is mounted to mounting portion 16, ink supply portion 20 overlaps protrusion 30 in a plane view.

Protrusion 30 has a first surface facing ink supply portion 20 and a second surface facing toward the second end of side wall 20*a*. Each of the first surface and the second surface of protrusion 30 may have a plurality of inclined planes 31 and a plurality of inclined planes 32. The plurality of inclined planes 31 and the plurality of inclined planes 32 are arranged alternately in the width direction, and each pair of inclined plane 31 and inclined plane 32 cross at an acute angle, forming a valley 33 or a peak 34 therebetween. In other words, each of the first surface and the second surface of protrusion 30 may have a plurality of grooves 38 formed therein. Each valley 33 extends from side wall 20*a* to end surface 22*a*. In other words, each valley 33 extends in the direction which protrusion 30 extends. Accordingly, each of the first surface and the second surface of protrusion 30 may have a zigzagged shape. A width of grooves 38 corresponding to a distance t between immediate neighboring peaks 34 may be less than or equal to 5 mm, e.g., about 2 mm, and a distance t between a peak 35 positioned at an end of protrusion 30 and an immediate neighboring peak 34 also may be less than or equal to 5 mm, e.g., about 2 mm. Because the width of groove 38 maybe less than or equal to 5 mm, a capillary force may be generated in valley 33. In operation, ink may drip from ink supply portion 22 or ink supply tube 17. Valley 33 is configured to receive and to retain the ink therein via the capillary force. The width of groove 38 may become narrower while approaching the bottom of valley 33. The bottom of valley is the point where inclined plane 31 and inclined plane 32 connect. The capillary force is strongest where groove 38 approaches the bottom of valley 33. Therefore ink is securely retained in valley 33.

Referring to FIGS. 3(*a*) and 3(*b*), ink supply tube 17 is provided in mounting portion 16. Ink supply tube 17 is inserted into ink supply path 23 through ink supply opening 24 when ink cartridge 20 is mounted to mounting portion 16. End surface 17*a* of ink supply tube 17 is positioned closer to ink cartridge 20 than end wall 16*b* is positioned to ink cartridge 20. A cylindrical joint portion 14 is positioned at an outside surface 16*c* of end wall 16*b*. One end of tube 15 is connected to joint portion 14. A communication hole 16*d* is formed through end wall 16*b*. A communication hole 17*b* formed through ink supply tube 17 and a communication hole 14*a* formed through joint portion 14 communicates through communication hole 16*d*. Ink may be supplied from ink chamber 21 to inkjet head 2 through communication hole 17*b*, communication hole 16*d*, communication hole 14*a* and tube 15.

A round recess 18 is formed in end wall 16*b*, and ink supply tube 17 extends from the bottom of round recess 18. Round recess 18 is configured to receive ink supply portion 22 when ink cartridge 20 is mounted to mounting portion 16. The depth of round recess 18 is greater than or equal to the distance which ink supply portion 22 extends from side wall 20*a*, and a portion of end surface 17*a* is cut out.

A recess 19 is formed in end wall 16*b*, and recess 19 is configured to receive protrusion 30 when ink cartridge 20 is mounted to mounting portion 16. Cross-sectional shapes of recess 19 taken along a plane perpendicular to the direction which ink cartridge 20 is mounted to mounting portion 16 are the same at any position of recess 19. The cross-sectional shape of recess 19 is similar to the cross-sectional shape of protrusion 30 and the size of recess 19 may be greater than or equal to the size of protrusion 30. Recess 19 receives protrusion 30 and positions ink cartridge 20 accurately in mounting portion 16. In an embodiment, a plurality of ink cartridges 20 may be used. For example, four ink cartridges 20 may be used, and each ink cartridge 20 may contain a different-color ink, such as cyan, magenta, yellow and black respectively, and four mounting portions 16 may be used, which receive the four ink cartridges 20 respectively. Protrusions 30 of the four ink cartridges may have different cross-sectional shapes, respectively, and recesses 19 may have different cross-sectional shapes corresponding to the cross-sectional shapes of protrusions 30, respectively. This may prevent an insertion of ink cartridge 20 into a wrong mounting portion 16. For example, an insertion of ink cartridge 20 containing yellow ink into the mounting portion 16 which is configured to receive ink cartridge 20 containing black ink may be prevented.

A switch 13 is provided at the bottom of recess 19, and switch 13 comprises a moveable member and a spring. The moveable member is urged by the spring to extend from the bottom of recess 19. When the ink cartridge 20 is inserted into mounting portion 16, end surface 30*a* of protrusion 30 pushes the moveable member against the urging force of the spring. When the moveable member is pushed, a signal is transmitted to a control means, and the control means determines whether the mounting of ink cartridge 20 is complete based on the signal. Therefore, a printing operation with ink cartridge 20 not mounted completely may be prevented. If the printing operation occurs with ink cartridge 20 not mounted completely, air may be drawn inside the inkjet head, resulting in a misprinting. Protrusion 30 functions not only as a means for retaining ink, but also as a means for determining whether the mounting of ink cartridge 20 is complete. This dual function provided by protrusion 30 reduces the number of parts of ink cartridge 20.

When ink cartridge 20 is mounted from the state shown in FIG. 3(*a*) to the state shown in FIG. 3(*b*), end surface 17*a* of ink supply tube 17 pushes valve 28 against the urging force of coil spring 27. Because the outside surface of ink supply tube 17 contacts seal 25 during the mounting operation, ink in ink chamber 21 and wider portion 26 does not leak through seal 25, and instead flows in to communication hole 17*b* through the cut-out formed in end surface 17*a*. Accordingly, when ink cartridge 20 is mounted to mounting portion 16, ink may not leak.

Figure 4A:
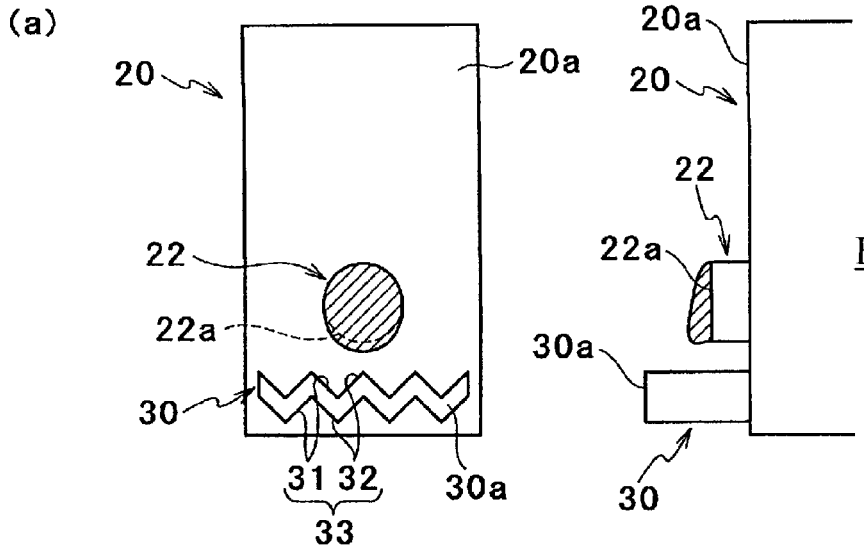
FIG. 4(*a*) is a schematic diagram of the ink cartridge of FIG. 1, when ink adheres to an ink supply portion.
Figure 4B:
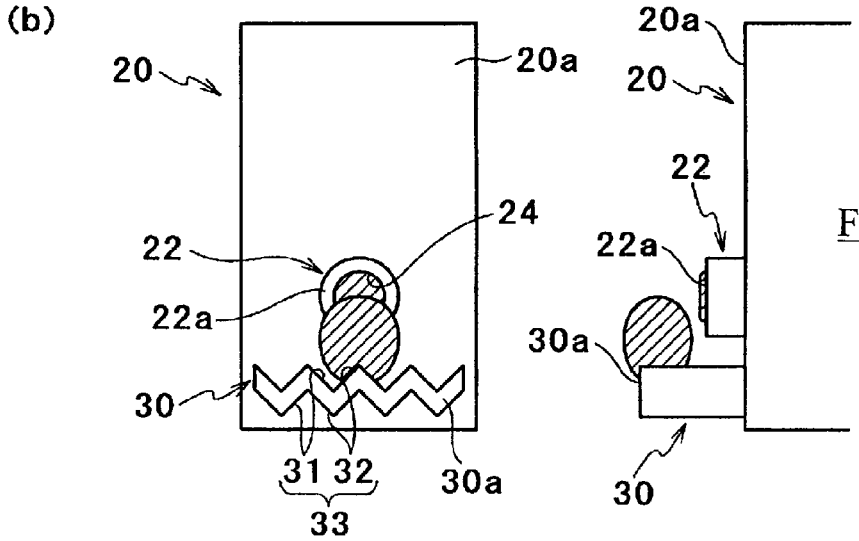
Figure 4C:
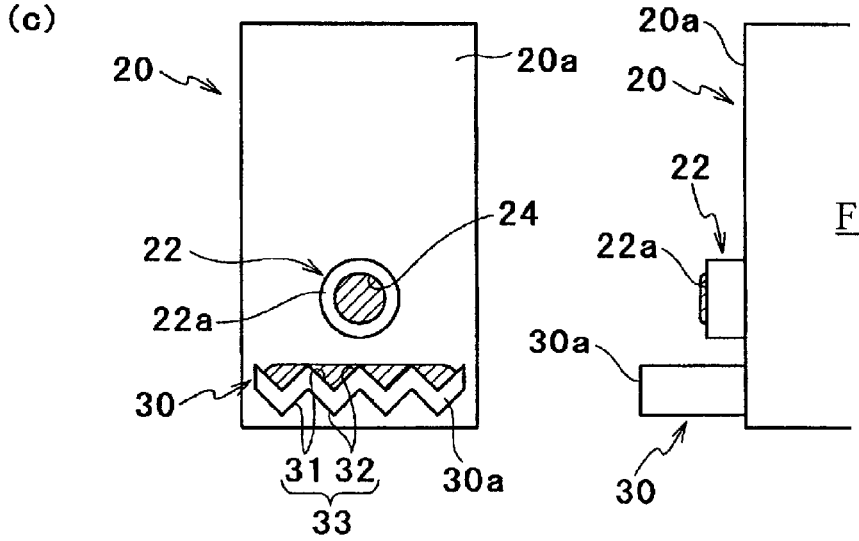

Nevertheless, when ink cartridge 20 is removed from mounting portion 16, ink may leak. When ink supply tube 17 is removed from ink supply path 23, valve 28 is pushed back to contact connecting surface 29, and valve 28 may push ink from wider portion 26 toward ink supply opening 24, and this ink may drip from ink supply opening 24. In addition, when ink supply tube 17 is removed from ink supply path 23, ink adhering to outside surface of ink supply tube 17 may adhere to an area adjacent to ink supply opening 24, and this ink may drip from ink supply opening 24. Referring to FIG. 4(*a*), ink adhering to end surface 22*a* may be retained on end surface 22*a* by surface tension. Nevertheless, referring to FIG. 4(*b*), when the amount of ink is too large, ink drips off. In addition, ink adhering to the outside surface of ink supply tube 17 may drip off when ink supply tube 17 removed from ink supply opening 24.

Referring to FIG. 4(*c*), ink which has dripped from end surface 22 and/or the outside surface of ink supply tube 17 may land on about a center of protrusion 30 and may spread into valleys 33 along inclined planes 31 and inclined planes 32. Ink may be retained within each valley 33. Because the first surface and the second surface of protrusion 30 include valleys which create capillary forces, protrusion 30 as a whole can retain ink. Ink may be retained in protrusion 30 regardless of the orientation of ink cartridge 20 after ink cartridge 20 is removed from mounting portion 16. For example, even when ink cartridge 20 is oriented, such that protrusion 30 is positioned above ink supply portion 22, ink may be retained in protrusion 30.

As discussed above, when ink cartridge 20 is removed from mounting portion 16, protrusion 30 may receive ink which has dripped from ink supply opening 24/end surface 22*a* and/or from the outside surface of ink supply tube 17, and ink may be retained in protrusion 30 by capillary forces generated within grooves 38 or valleys 33. Accordingly, mounting portion 16 may not become dirtied by ink.

Because protrusion 30 extends from side wall 20*a*, protrusion 30 may securely receive ink, and the structure of ink cartridge 20 may be simplified, and because protrusion 30 is positioned below ink supply portion 22, protrusion 30 may securely receive ink. Moreover, because the width of distance t or grooves 38 is less than or equal to 5 mm, received ink may be securely retained in protrusion 30, and because grooves 38 or valleys 33 are provided at the first surface of protrusion 30 facing ink supply portion 22, ink may be securely received and retained by protrusion 30, and it may be difficult for the ink to move once the ink is positioned on protrusion 30.

Figure 5:
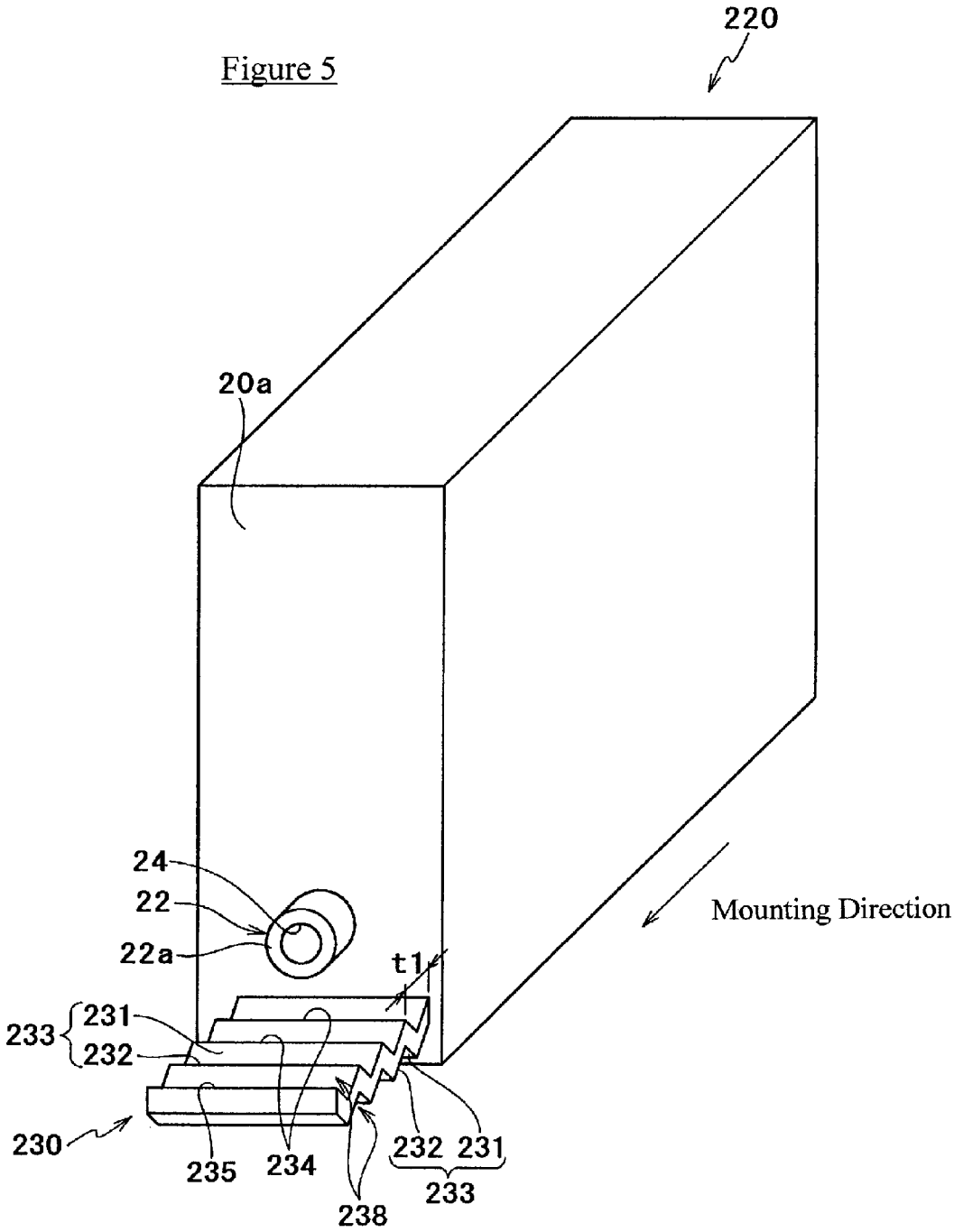
FIG. 5 is a perspective view of an ink cartridge, according to another embodiment of the present invention.

FIG. 5 is a perspective view of an ink cartridge 220, according to another embodiment of the present invention. Ink cartridge 220 may be similar to ink cartridge 20. Therefore, only those differences between ink cartridge 220 and ink cartridge 20 are discussed with respect to ink cartridge 220.

Referring to FIG. 5, ink cartridge 220 comprises a protrusion 230 extending from side wall 20*a*. Protrusion 230 has an end surface 230*a* which is most distant from side wall 20*a*. End surface 230*a* is more distant from side wall 20*a* than end surface 22*a* is from sidewall 20*a*. Protrusion 230 has a first surface facing ink supply portion 20 and a second surface facing toward the second end of side wall 20*a*. Each of the first surface and the second surface of protrusion 230 has a plurality of inclined planes 231 and a plurality of inclined planes 232. The plurality of inclined planes 231 and the plurality of inclined planes 232 are arranged alternately in the direction that protrusion 230 extends from side wall 20*a*, and each pair of inclined plane 231 and inclined plane 232 cross at an acute angle, forming a valley 233 or a peak 234 therebetween. Each valley 233 extends in the width direction which is perpendicular to the direction that protrusion 230 extends from side wall 20*a*. Accordingly, each of the first surface and the second surface of protrusion 230 is formed into a zigzagged shape. In other words, each of the first surface and the second surface of protrusion 230 has a plurality of grooves 238 formed therein. A width of grooves 238 corresponding to a distance t1 between immediate neighboring peaks 234 may be less than or equal to 5 mm, and a distance t1 between a peak 235, which is positioned at an end of protrusion 230 in the direction that protrusion 230 extends from side wall 20*a*, and an immediate neighboring peak 234 also may be less than or equal to 5 mm. Protrusion 230 may receive and retain ink which has dripped from ink supply opening 24/end surface 22*a* and/or the outside surface of ink supply tube 17.

Figure 6:
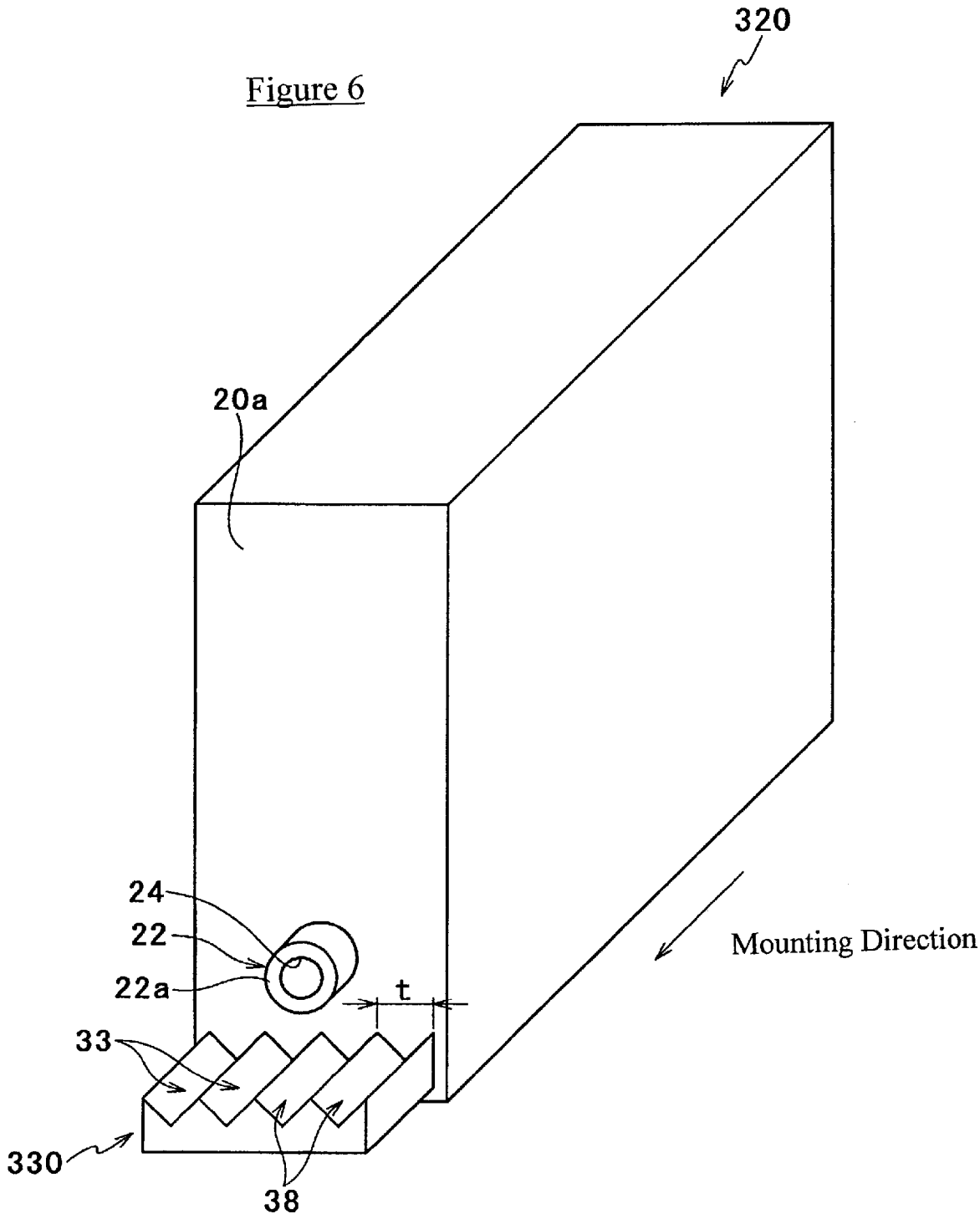
FIG. 6 is a perspective view of an ink cartridge, according to yet another embodiment of the present invention.

FIG. 6 is a perspective view of an ink cartridge 320, according to yet another embodiment of the present invention. Ink cartridge 320 may be similar to ink cartridge 20. Therefore, only those differences between ink cartridge 320 and ink cartridge 20 are discussed with respect to ink cartridge 320. Referring to FIG. 6, ink cartridge 320 comprises a protrusion 330 extending from side wall 20*a*. The second surface of protrusion 330 facing toward the second end of side wall 20*a* is flat. Therefore, the second surface may not retain ink thereon. Nevertheless, the shape of protrusion 330 is simplified with respect to ink cartridge 20, and the surface of protrusion 330 facing ink supply portion 22 provides a similar effect as the first surface of protrusion 30.

Figure 7:
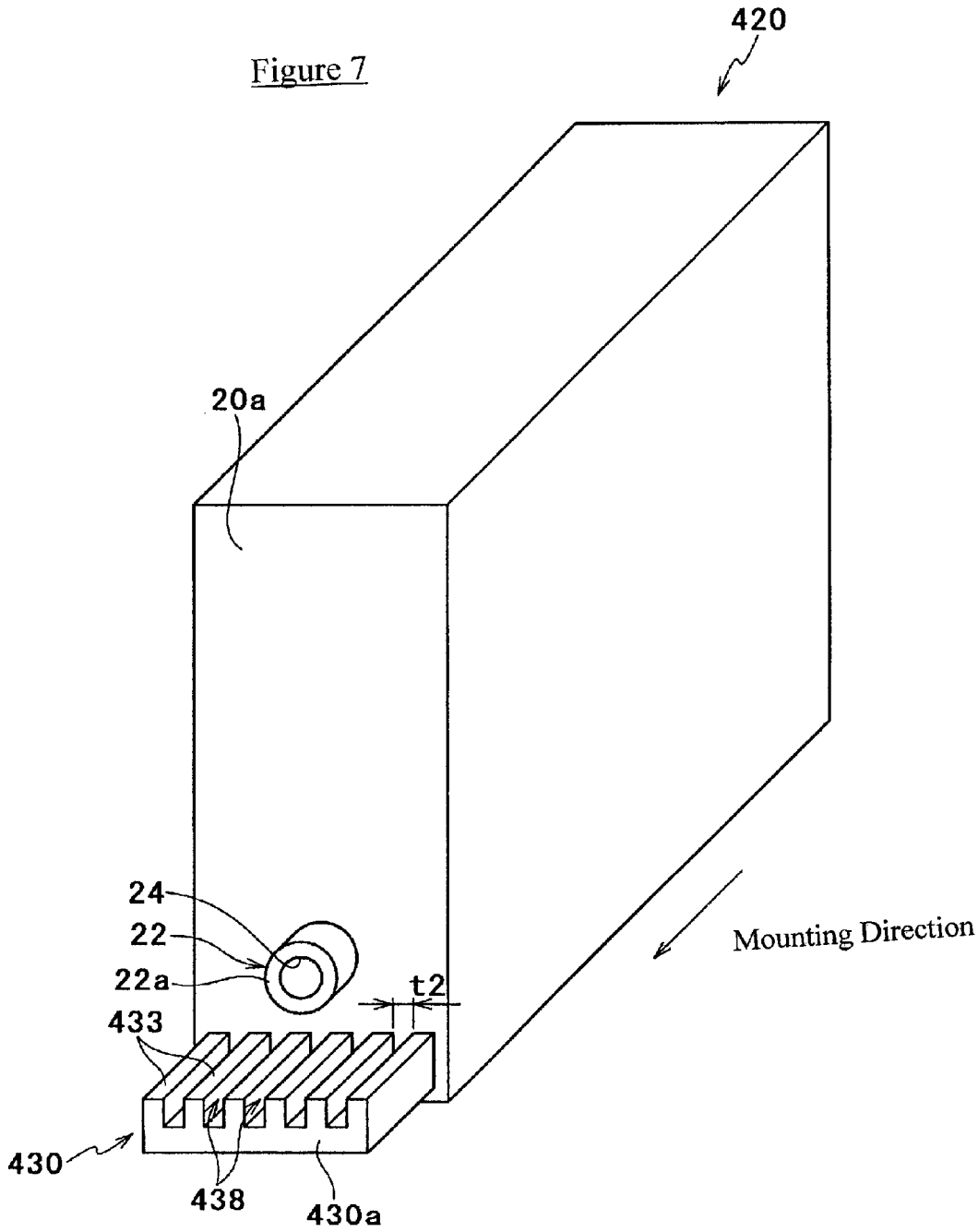
FIG. 7 is a perspective view of an ink cartridge, according to still another embodiment of the present invention.

FIG. 7 is a perspective view of an ink cartridge 420, according to still another embodiment of the present invention. Ink cartridge 420 may be similar to ink cartridge 20. Therefore, only those differences between ink cartridge 420 and ink cartridge 20 are discussed with respect to ink cartridge 420. Referring to FIG. 7, ink cartridge 420 comprises a protrusion 430 extending from side wall 20*a*. Protrusion 430 has an end surface 430*a* which is most distant from side wall 20*a*. End surface 430*a* is more distant from side wall 20*a* than end surface 22*a* is from side wall 20*a*. Protrusion 430 has a first surface facing ink supply portion 20, and a second surface facing toward the second end of side wall 20*a*. The first surface has a plurality of protruding portions 433 which extend toward ink supply portion 22 and are arranged in the width direction, such that grooves 438 are formed between adjacent protruding portions 433. Each of grooves 438 extends in the direction which protrusion 430 extends from side wall 20*a* to end surface 430*a*. Groove 438 is defined by a bottom surface, a side surface of one of protruding portions 433 extending from the bottom surface, and a side surface of an adjacent protruding portion 433. The two side surfaces are parallel to each other. A width of groove 438 corresponds to a distance t2 between the two side surfaces, which is less than or equal to 5 mm. The first surface of protrusion 430 facing ink supply portion 22 provides a similar effect as the first surface of protrusion 30.

Figure 8:
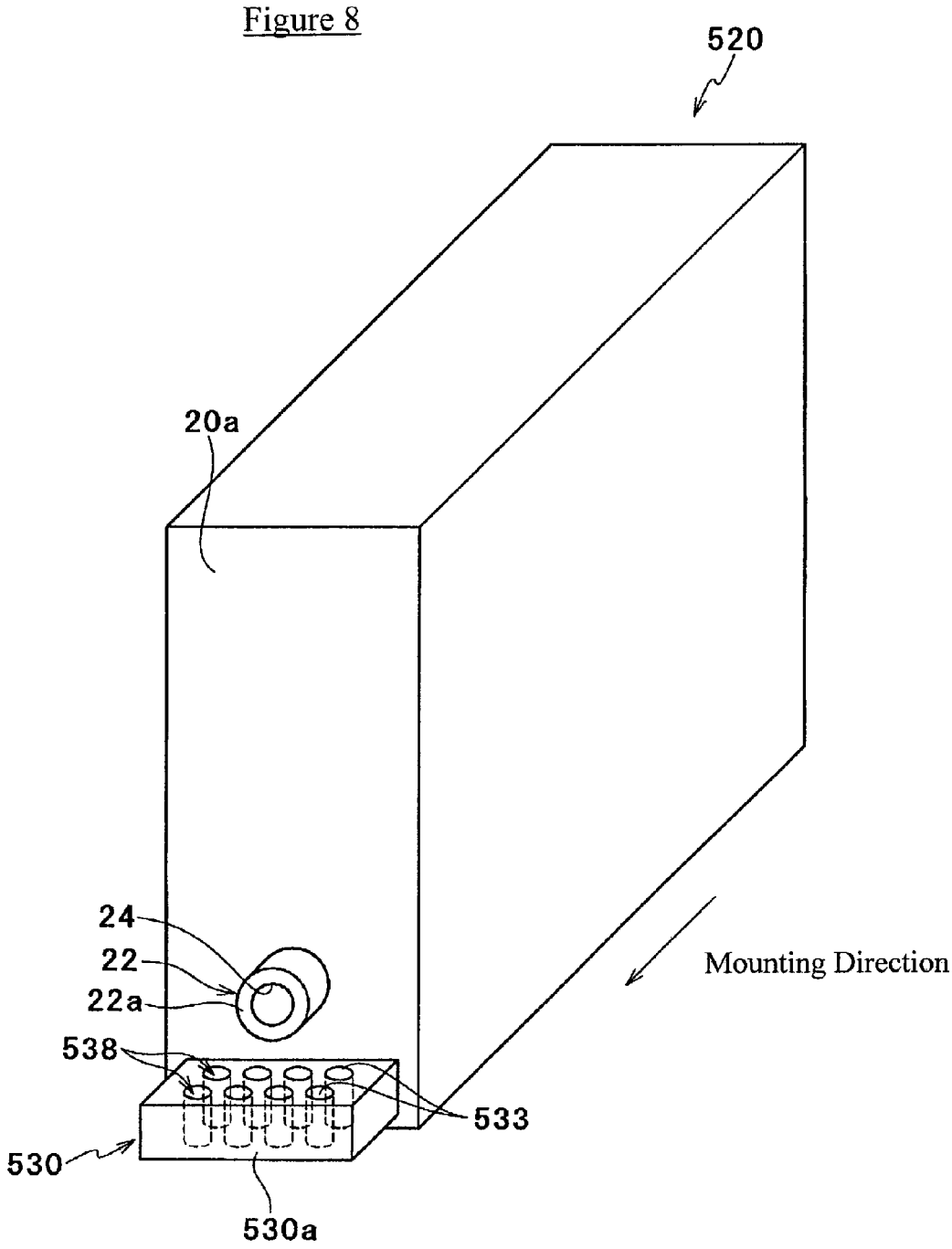
FIG. 8 is a perspective view of an ink cartridge, according to still yet another embodiment of the present invention.

FIG. 8 is a perspective view of ink cartridge 520, according to still yet another embodiment of the present invention. Ink cartridge 520 may be similar to ink cartridge 20. Therefore, only those differences between ink cartridge 520 and ink cartridge 20 are discussed with respect to ink cartridge 520. Referring to FIG. 8, ink cartridge 520 comprises protrusion 530 extending from side wall 20*a*. Protrusion 530 has an end surface 530*a*, which is most distant from side wall 20*a*. End surface 530*a* is more distant from side wall 20*a* than end surface 22*a* is from sidewall 20*a*. Protrusion 530 has a rectangular parallelepiped shape, and has a plurality of holes 533 (538) formed therethrough or therein in the height direction. The diameter of each hole 533 is less than or equal to 5 mm, which creates a capillary force within holes 533. Protrusion 530 may receive ink which has dripped from ink supply opening 24/end surface 22*a* and/or from the outside surface of ink supply tube 17, and the ink may be retained in protrusion 530 by the capillary forces generated within holes 533. Because holes 533 are formed, a relatively large amount of ink may be retained in protrusion 530. When an ink droplet drips on to a first surface of protrusion 530 facing ink supply portion 22, ink which already is retained within holes 533 tends to be united with the ink droplet. Therefore, ink within holes 533 holds the ink on the first surface, and it may be difficult for the ink on the first surface to move.

Figure 9:
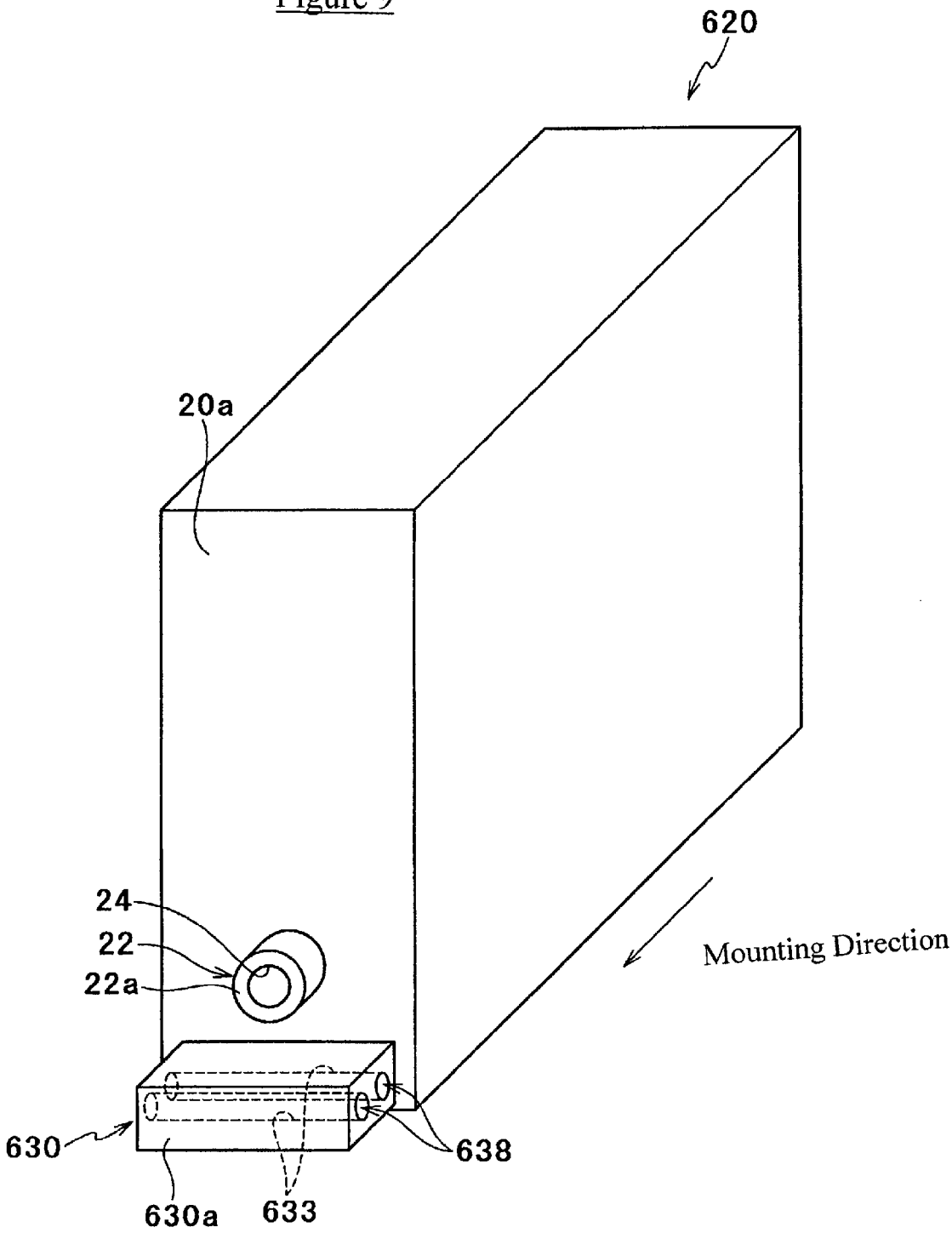
FIG. 9 is a perspective view of an ink cartridge, according to a further embodiment of the present invention.

FIG. 9 is a perspective view of ink cartridge 620, according to a further embodiment of the present invention. Ink cartridge 620 may be similar to ink cartridge 20. Therefore, only those differences between ink cartridge 620 and ink cartridge 20 are discussed with respect to ink cartridge 620. Referring to FIG. 9, ink cartridge 620 comprises a protrusion 630 extending from side wall 20*a*. Protrusion 630 has an end surface 630*a*, which is most distant from side wall 20*a*. End surface 630*a* is more distant from side wall 20*a* than end surface 22*a* is from side wall 20*a*. Protrusion 630 has a rectangular parallelepiped shape, and has a plurality of holes 633 (638) formed therethrough or therein in the width direction. The diameter of each hole 633 is less than 5 mm, which creates a capillary force within hole 633. Protrusion 630 may receive ink which has dripped from ink supply opening 24/end surface 22*a* and/or from the outside surface of ink supply tube 17, on a first surface facing ink supply portion 22. The ink may flow along the first surface and surfaces extending from the first surface, and then may flow into holes 633 and may be retained in protrusion 630 by the capillary forces generated within holes 633.

The present invention is not limited to the above-described embodiments. Various modifications may be applied. For example, a direction which protrusion 30, 230, 330, 430, 530, 630 extends may not be parallel with the direction that the ink cartridge 20, 220, 320, 420, 520, 620 is mounted to mounting portion 16. In this case, recess 19 may extend to correspond to the direction which protrusion 30, 230, 330, 430, 530, 630 extends. Switch 13 is not limited to a physical switch. Switch 13 may detect protrusion 30, 230, 330, 430, 530, 630 optically. For example, switch 13 may emit visible light or infra red light. Ink supply portion 22 may not extend from side wall 20*a*. In this case, ink may leak from ink supply opening 24 and may flow on to protrusion 30, 230, 330, 430, 530, 630 along side wail 20*a* and may be retained in protrusion 30, 230, 330, 430, 530, 630. Moreover, grooves 38, 238, 338, 438, and holes 538 and 638 may be greater than 5 mm. For example, ink may be retained in the grooves or holes depending on the viscosity of ink or the surface tension of the ink with respect to material of protrusion 30, 230, 330, 430, 530, 630.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. An ink cartridge configured to be mounted on a surface of a mounting portion, comprising:

an ink chamber configured to store an ink;

a wall comprising a first end and a second end opposite the first end;

an ink supply portion configured to supply the ink from an interior of the ink chamber to an exterior of the ink chamber, wherein the ink supply portion is positioned at the wall adjacent to the second end of the wall; and a protrusion extending from the wall, wherein the protrusion is positioned between the ink supply portion and the second end of the wall, and the protrusion has a plurality of grooves formed therein.

2. The ink cartridge of claim 1, wherein each plurality of grooves are configured to retain ink therein by a capillary force.

3. The ink cartridge of claim 1, wherein the ink supply portion comprises an ink supply path formed therethrough, and the ink supply path provides fluid communication between the interior of the ink chamber and the exterior of the ink chamber, wherein the ink supply path and the protrusion extend in a predetermined direction.

4. The ink cartridge of claim 3, wherein the ink supply portion extends from the wall in the predetermined direction and the protrusion extends from the wall further than the ink supply portion extends from the wall.

5. The ink cartridge of claim 4, wherein the ink supply portion is aligned with the protrusion between the first end of the wall and the second end of the wall.

6. The ink cartridge of claim 3, wherein the ink supply portion comprises a valve configured to selectively open and close the ink supply path.

7. The ink cartridge of claim 1, wherein a width of each of the plurality of grooves is less than or equal to 5 mm.

8. The ink cartridge of claim 1, wherein the plurality of grooves are formed in a surface of the protrusion facing the ink supply portion.

9. The ink cartridge of claim 8, wherein each of the plurality of grooves are defined by a pair of inclined planes of the surface, which cross at an acute angle.

10. The ink cartridge of claim 1, wherein each of the plurality of grooves and the protrusion extend in a predetermined direction.

11. The ink cartridge of claim 1, wherein the protrusion extends in a predetermined direction, and each of a the plurality of grooves extend in a further direction which is substantially perpendicular to the predetermined direction.

12. An inkjet printer, comprising:

a mounting portion; and an ink cartridge mounted on a surface of the mounting portion, wherein the ink cartridge comprises:

an ink chamber configured to store an ink;

a wall comprising a first end and a second end opposite the first end;

an ink supply portion configured to supply the ink from an interior of the ink chamber to an exterior of the ink chamber, wherein the ink supply portion is positioned at the wall adjacent to the second end of the wall; and a protrusion extending from the wall, wherein the protrusion is positioned between the ink supply portion and the second end of the wall, and the protrusion has a plurality of grooves formed therein, wherein the mounting portion has a recess formed therein, and the recess is configured to receive the protrusion, wherein the mounting portion comprises a detector configured to detect a presence of the protrusion.

13. An ink cartridge configured to be mounted on a surface of a mounting portion, comprising:

an ink chamber configured to store an ink;

a wall comprising a first end and a second end opposite the first end;

an ink supply portion configured to supply the ink from an interior of the ink chamber to an exterior of the ink chamber, wherein the ink supply portion is positioned at the wall adjacent to the second end of the wall; and a protrusion extending from the wall, wherein the protrusion is positioned between the ink supply portion and the second end of the wall, and the protrusion has a plurality of holes formed therein or therethrough.

14. The ink cartridge of claim 13, wherein the ink supply portion comprises an ink supply path formed therethrough, and the ink supply path provides fluid communication between the interior of the chamber and the exterior of the ink chamber, wherein ink supply path and the protrusion extends in a predetermined direction.

15. The ink cartridge of claim 14, wherein the ink supply portion extends from the wall in the predetermined direction and the protrusion extends from the wall further than the ink supply portion extends from the wall.

16. The ink cartridge of claim 15, wherein the ink supply portion is aligned with the protrusion between the first end of the wall and the second end of the wall.

17. The ink cartridge of claim 14, wherein the plurality of holes are formed through the protrusion in a direction from the first end of the wall to the second end of the wall.

18. The ink cartridge of claim 14, wherein the ink supply portion comprises a valve configured to selectively open and close the ink supply path.

19. An inkjet printer, comprising:

a mounting portion; and an ink cartridge mounted on a surface of the mounting portion, wherein the ink cartridge comprises:

an ink chamber configured to store an ink;

a wall comprising a first end and a second end opposite the first end;

an ink supply portion configured to supply the ink from an interior of the ink chamber to an exterior of the ink chamber, wherein the ink supply portion is positioned at the wall adjacent to the second end of the wall; and a protrusion extending from the wall, wherein the protrusion is positioned between the ink supply portion and the second end of the wall, and the protrusion has a plurality of holes formed therein or therethrough, wherein the mounting portion has a recess formed therein, and the recess is configured to receive the protrusion, wherein the mounting portion comprises a detector configured to detect a presence of the protrusion.

20. An ink cartridge configured to be mounted on a surface of a mounting portion, comprising:

an ink chamber configured to store an ink;

a wall comprising a first end and a second end opposite the first end;

an ink supply portion configured to supply the ink from an interior of the ink chamber to an exterior of the ink chamber, wherein the ink supply portion is positioned at the wall adjacent to the second end of the wall; and a protrusion extending from the wall, wherein the protrusion is positioned between the ink supply portion and the second end of the wall, and the protrusion comprises means for generating a capillary force which acts upon the ink when the ink is positioned on the protrusion.

21. The ink cartridge of claim 20, wherein the means for generating comprises a plurality of grooves formed in the protrusion.

22. The ink cartridge of claim 20, wherein the means for generating comprises a plurality of holes formed through or within the protrusion.

* * * * *